US005604428A

United States Patent [19]

Koblitz et al.

[11] Patent Number: 5,604,428

[45] Date of Patent: Feb. 18, 1997

[54] DEVICE FOR GENERATING INTERMEDIATE VOLTAGES

[75] Inventors: Rudolf Koblitz, Meylan, France; Karl D. Nutz, Oedheim; Jürgen Steiner, Waldenburg, both of Germany

[73] Assignee: Deutsche Thomson-Brandt GmbH, Villingen-Schwenningen, Germany

[21] Appl. No.: 462,015

[22] Filed: Apr. 27, 1995

Related U.S. Application Data

[63] Continuation of Ser. No. 185,816, filed as PCT/EP92/02061, Sep. 7, 1992, abandoned.

[30] Foreign Application Priority Data

Sep. 19, 1991 [DE] Germany ..... 41 31 170.1

[51] Int. Cl.[6] ..... G05F 3/16

[52] U.S. Cl. ..... 323/316; 323/314; 327/535; 327/333

[58] Field of Search ..... 327/539, 534, 327/535, 333; 323/314, 316

[56] References Cited

U.S. PATENT DOCUMENTS

| | | | |
|---|---|---|---|
| 3,754,787 | 8/1973 | Kreitz et al. | 323/7 |
| 3,887,863 | 6/1975 | Brokaw | 323/79 |
| 4,099,775 | 7/1978 | Watanabe | 323/79 |
| 4,774,452 | 9/1988 | Ahmed | 323/314 |
| 5,013,996 | 5/1991 | Conzelmann et al. | 322/28 |

FOREIGN PATENT DOCUMENTS

| | | |
|---|---|---|
| 302488 | 2/1972 | Austria . |
| 2437700 | 2/1976 | Germany . |

*Primary Examiner*—Peter S. Wong
*Assistant Examiner*—Shawn Riley
*Attorney, Agent, or Firm*—Joseph S. Tripoli; Joseph J. Laks; Francis A. Davenport

[57] ABSTRACT

An apparatus for generating an intermediate voltage having a value between a positive voltage supply value and a negative supply value. The apparatus has low power dissipation and is dynamically stable over a range of external supply voltages. The apparatus comprises a voltage comparator having first and second input terminals and a control signal output terminal. A reference voltage generator is coupled to the positive voltage supply and generates a reference voltage which is coupled to the first input terminal of the comparator. A device having a zener characteristic is coupled to the positive voltage supply and generates a voltage which is coupled to the second input terminal of the comparator. A current source is coupled to the negative voltage supply and generates a current which is coupled to a terminal, to form the intermediate voltage, and is also coupled to the device to determine the voltage generated thereby. The voltage and the reference voltage are compared in the comparator which generates a control signal proportional to a difference therebetween which is coupled to control the current source.

10 Claims, 4 Drawing Sheets

DEVICE FOR GENERATING INTERMEDIATE VOLTAGES

This application is a continuation of application Ser. No. 08/185,816, filed as PCT/EP92/02061 Sep. 7, 1992, now abandoned.

This invention relates to the field of DC power supply, and in particular to the generation of an intermediate voltage for use in integrated circuitry.

BACKGROUND OF THE INVENTION

Certain electronic circuit applications may require intermediate voltages to be generated in addition to the maximum positive and negative supply voltages applied from outside. It is generally known that semiconductor components are designed for certain blocking voltages for reasons of the manufacturing process used. Hence, voltage differences within a component manufactured according to such a process must not exceed the appropriate blocking voltages. For example, the differences in voltages which lie between the base region, insulation/substrate (bulk) terminal and the collector terminal, i.e. its epitaxial regions, in a bipolar NPN transistor fabricated by integrated circuit process. The structure of semiconductor components is known and this aspect needs no further discussion.

Systems are known which provide intermediate voltages over a wide range of supply voltages applied from outside. Intermediate voltage values between those of the applied voltages from may be realized, for example, by a voltage divider. However, such voltage divider methods are characterized by a relatively high power dissipation or by poor dynamic stability, for example, resulting from capacitive coupling between epitaxial regions and the substrate.

SUMMARY OF THE INVENTION

It is an object of the present invention to realize a circuit which generates intermediate voltages over a wide range of voltages (Vpos, Vneg) applied from outside and possesses low power dissipation, good dynamic stability. The inventive circuit may be realized as a power dissipation part of an integrated circuit.

An apparatus for generating an intermediate voltage having a value between a positive voltage supply value and a negative supply value, said apparatus comprising a voltage comparator having first and second input terminals and a control signal output terminal. A reference voltage generator is coupled to said positive voltage supply generating a reference voltage for coupling to said first input terminal. A device having a zener characteristic is coupled to said positive voltage supply and generates a voltage for coupling to said second input terminal. A current source is coupled to said negative voltage supply and generates a current for coupling to a terminal to form said intermediate voltage and to said device to determine said voltage generated thereby. Said voltage and said reference voltage are compared, and responsive to a difference therebetween, said comparator generates a control signal for coupling to control said current source.

Depending on the absolute value of the direct voltage supply applied from outside, a current is controlled through an arrangement of semiconductor components, primarily realizing the function of a Zener diode, in such a way that the intermediate voltage does not drop below a predetermined value.

Using the intermediate voltage generated according to the invention permits desired circuit functions to be realized. The inventive device also permits the potential from the terminals of a component, for example, the substrate terminal of a bipolar NPN transistor, to be set to such a value that the voltage differences between the individual regions of the component do not exceed predetermined values. All circuit sections which, as far as the potential is concerned, operate below the intermediate voltage, lie with their epitaxial regions (collector with an NPN transistor, base with a PNP transistor, as well as epitaxial trough for resistors) above or in any case equal to the intermediate voltage as far as the potential is concerned.

Thus, voltages applied from outside, having values above the blocking voltage values predetermined by a manufacturing process used may be utilized by integrated circuit arrangements. This has an advantage that a manufacturing process with greater integration density can be used. In addition the operational reliability of the integrated circuit arrangement under consideration is enhanced.

If the invention-type device is realized as a part of the integrated circuit which also contains the circuit arrangement to be provided with the intermediate voltage, then there also results the advantage that additional connecting means, such as casing terminals or bonding links, are not required.

The stable voltage output generated by the inventive circuitry may be coupled with a cascade connection, for example, a cascode circuit, to provide a stable controlled voltage for further stages.

DETAILED DESCRIPTION

Before the description of the embodiment example is gone into any further it should be pointed out that the blocks illustrated individually in the figures merely serve for the better understanding of the invention. Normally, single blocks or several of these blocks are combined into units. However, it is also possible that the facilities and elements contained in the individual stages can be constructed separately.

Figure 1:
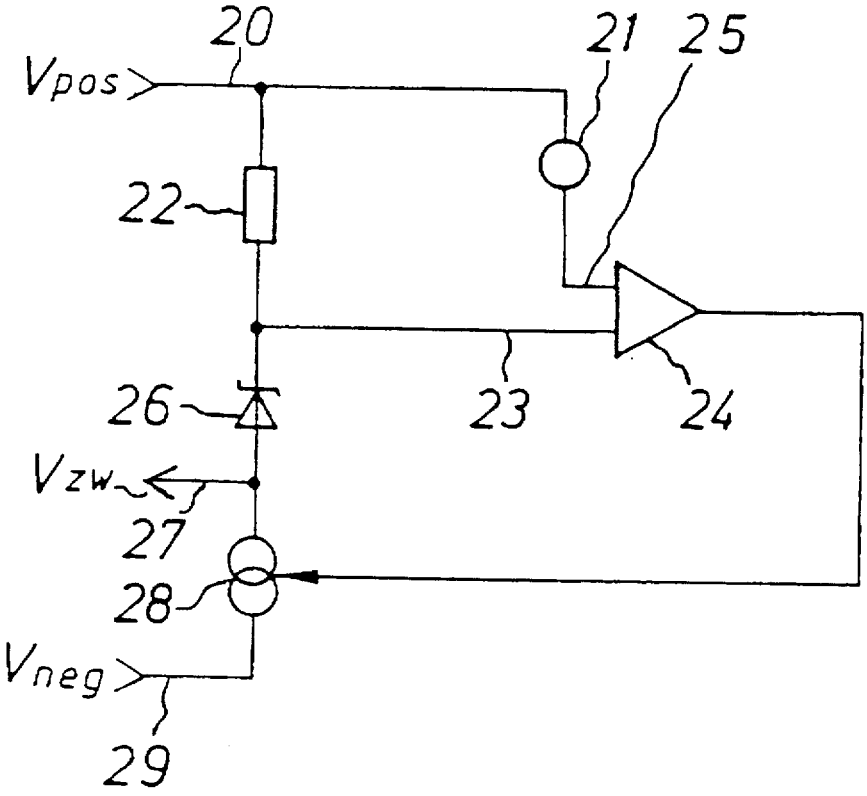
FIG. 1 shows a first inventive embodiment of the present invention.

In FIG. 1 a positive voltage Vpos is applied to a first connection terminal 20. Terminal 20 is connected to a first terminal of a voltage source 21 and to a first end of a resistor 22. For the sake of completeness it should be mentioned that Vpos represents a potential with the highest value occurring in the circuit arrangement under consideration. Referring to a connection to ground or a further potential, like for example, Vneg, which represents a potential with the lowest value which occurs in the circuit arrangement under consideration. The designation "voltage" is to be understood to mean other potentials as well.

The second end of resistor 22 is connected to a first input 23 of a comparator stage 24. A second input 25 of comparator stage 24 is wired to a second terminal of the voltage source 21. The second end of resistor 22 and the first input 23 of comparator stage 24 are connected to the cathode of a Zener diode 26. The anode of Zener diode 26 is connected to a second connection terminal 27 as well as a first input of a current source 28. The second terminal of current source 28 is wired to a third connection terminal 29 to which the negative voltage Vneg is applied. A control input of the current source 28 is connected to the output of the comparator stage 24. An intermediate voltage Vzw is available at the second connection terminal 27.

Figure 2:
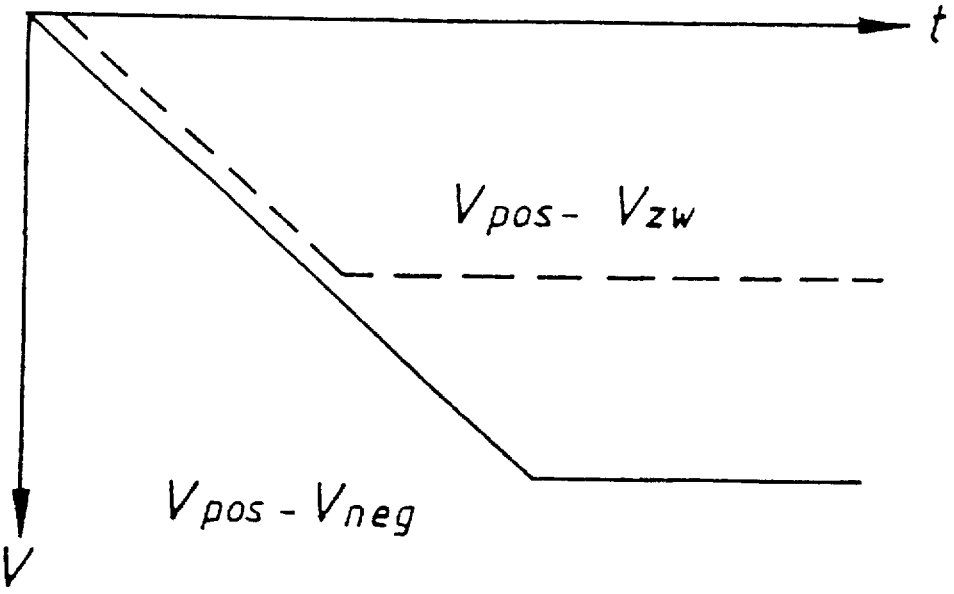
FIG. 2 shows voltage progressions according to the embodiment of FIG. 1.

The function of the inventive device of FIG. 1 is explained with the help of FIG. 2. The solid line plots the value of the voltage difference Vpos–Vneg, the dotted line indicates the value of the voltage difference Vpos–Vzw, both as a function of the time.

If the absolute value of the positive DC voltage applied to terminals 20 increase with time, then current will flow through resistor 22, Zener diode 26 and current source 28 to the negative DC voltage terminal 29. At low voltage values Zener diode 26 is blocked or non-conductive so that only a very small leakage current flows resulting in a small voltage drop across resistor 22. At higher voltage values, i.e. above the breakdown voltage of the Zener diode 26, the diode becomes conducting and at first a considerably larger current flows via the resistor 22 and current source 28. The value of this current is predetermined by current source 28. The value of the intermediate voltage Vzw corresponds essentially, i.e. apart from the saturation voltage of the current source 28, to the negative voltage Vneg.

This also means that a voltage drops at the resistor 22, the value of which is higher than that of a voltage predetermined by the reference voltage source 21. Voltage source 21 can be considered as a nominal (desired) value stage and the reference voltage output can be considered as a nominal voltage or generally as a nominal signal, and its value as a nominal value.

When the comparator 24 determines that the voltage drop across resistor 22 is higher than the nominal voltage 21, an output control signal is generated which is coupled to the current source 28. The control signal has the required polarity to reduce the current generated by current source 28. Hence, a current value is set such that the intermediate voltage Vzw essentially corresponds to the blocking voltage of the Zener diode and the voltage dropped at resistor 22 corresponds to the voltage supplied by voltage source 21.

Figure 3:
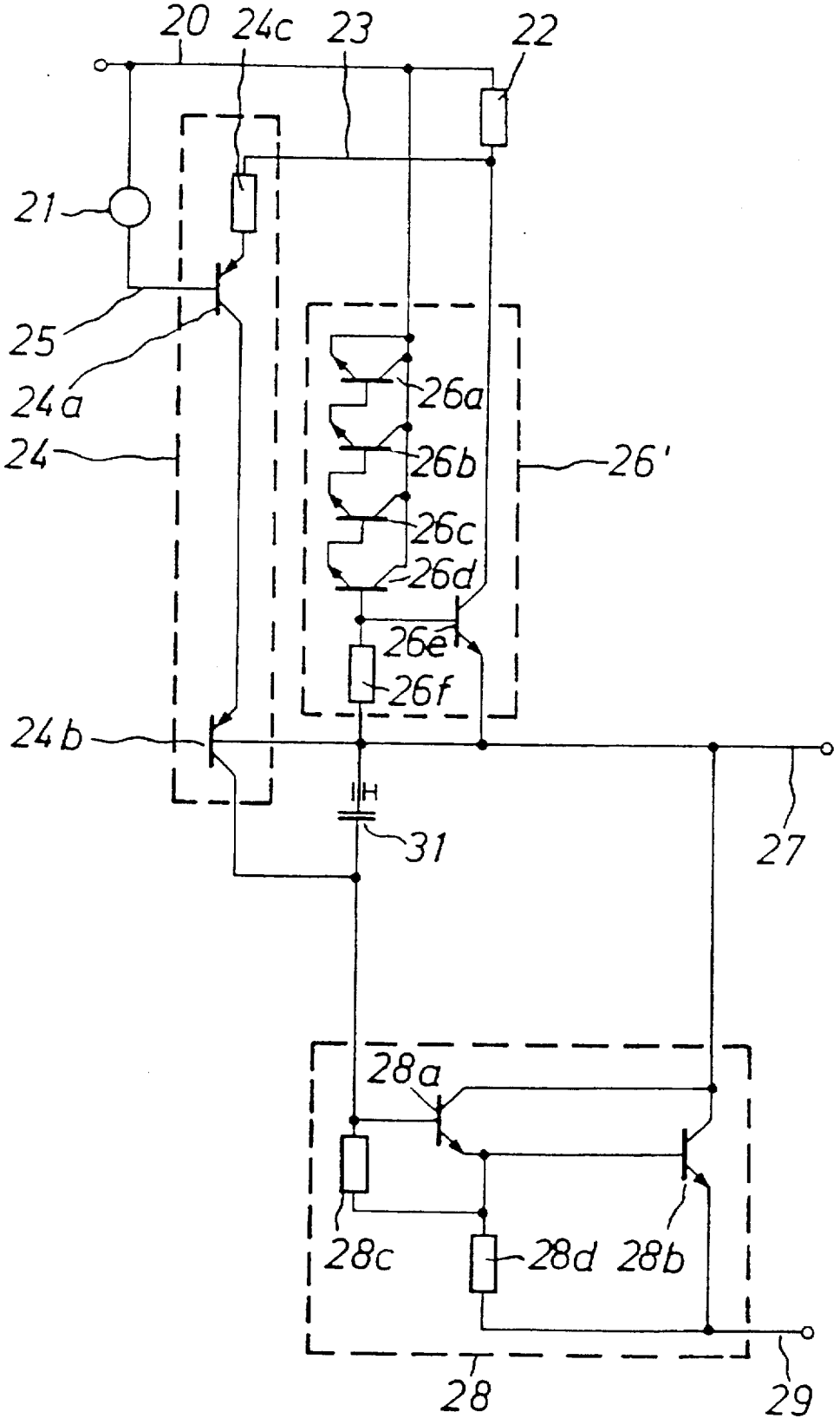
FIG. 3 shows a second inventive embodiment.

In a second inventive embodiment as illustrated in FIG. 3, components have been combined into subassemblies according to their function. Means, components and subassemblies performing the same function as corresponding means of FIG. 1, have been given the same reference numbers and these will only be mentioned in the following insofar as is significant to the understanding of the present invention.

The supply voltage Vpos applied to the first connection terminal 20 is also coupled via resistor 22 to the first input 23 of comparator stage 24. The comparator stage 24 contains a first comparator transistor **24*a*, a second comparator transistor 24*b* and a comparator resistor 24*c*, the first end of which is connected to the emitter of the first comparator transistor 24*a* and the second end of which leads to the first input 23. The collector of the first comparator transistor 24*a* is connected to the emitter of the second comparator transistor 24*b*, and the collector of this forms the output of comparator stage 24. The base of the second comparator transistor 24*b* is connected to the second connection terminal 27 to which the intermediate voltage Vzw is applied. Thus, transistors 24*a*, 24*b*** form a cascode amplifier stage.

The first input 23 and the first connection terminal 20 are further connected to a first Zener block 26', the function of which corresponds to that of the Zener diode 26. Zener block 26' contains Zener transistors **26*a*–26*e* and a Zener impedance 26*f*. To provide frequency response compensation a capacitor 31 is coupled between the second connection terminal 27 and the output of the comparator stage 24. A current source 28 is formed by a Darlington configured amplifier stage comprising a first current source transistor 28*a*, a second current source transistor 28*b* and suitable current source impedances 28*c*, 28*d*. The function of the inventive embodiment illustrated in FIG. 3 corresponds to that of the example shown in FIG. 1. However, it should be noted that the Zener block 26'** has a Zener voltage Vz corresponding to the value $$Vz=4*Vzt+Vbe$$

where Vzt is the Zener voltage of the Zener transistors **26*a*–26*e*, and VBE is the base-emitter voltage of the transistor 26*e*. With other numbers of Zener transistors, the factor "4" is modified accordingly. To prevent the blocking voltage, VCEO, of the second comparator transistor 24*b* being exceeded, the intermediate voltage Vzw is coupled to transistor 24*b* base. The comparator transistors 24*a*, 24*b*** may be considered to form a cascode amplifier stage.

Figure 4:
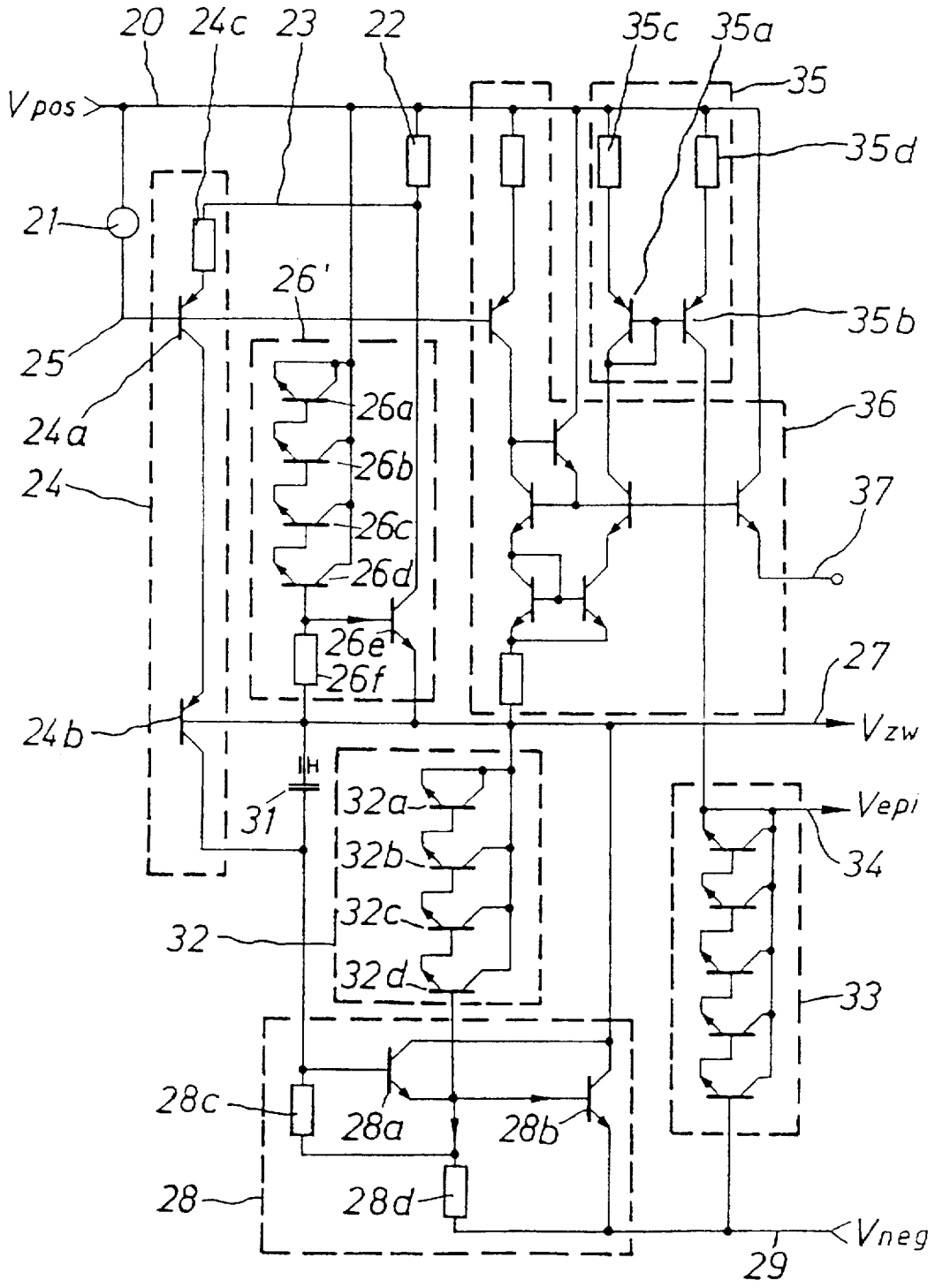
FIG. 4 shows additional circuit blocks added to the embodiment according to FIG. 4.

Further possible variations of the embodiment examples named can contain at least some of the stages indicated in FIG. 4. Apart from these additional stages, the blocks and components already named are illustrated in FIG. 4. These shall only be gone into in the following insofar as is necessary for the understanding of the present invention.

In FIG. 4, in addition to the stages already named, the anode of a second Zener block 32, containing Zener transistors **32*a*–32*d*, is connected to the current source 28, with the Zener block cathode connected to connection terminal 27. Zener block 32 provides a protection against the supply voltages Vpos, Vneg exceeding predetermined values. In this inventive embodiment the circuit arrangement would function as a Zener diode and limit the voltage applied to the connection terminals 20 and 29** to a value of $$8*Vzt+2*VBE.$$

However, that the current flowing through the circuit arrangement may not exceed predetermined values.

In a further variation a third Zener block 33 is provided, the anode of which is connected to the third terminal 29 and the cathode of which is connected to a fourth connection terminal 34 and a current reflector or mirror 35. A voltage Vepi, having a value of 5 * Vz above voltage Vneg, is provided at the fourth connection terminal 34. The third Zener block 33 is fed with a small current by the current reflector 35 which contains two transistors **35*a*, 35*b* as well as resistors 35*c*, 35*d***. The voltage Vepi is then particularly of interest if the voltages delivered serve to avoid that voltage difference values at a component, for example, a resistor, which lie above permissible values (VCBO). Such an application will be investigated further in the following.

In addition, a bias voltage stage 36 may be provided in the inventive circuit arrangement which generates a bias voltage Vvs with respect to the intermediate voltage Vzw, having a predetermined value, for example, VBE+0.6 V. Bias voltage Vvs is coupled to a fifth connection terminal 37.

The output voltages generated by the inventive device, such as the intermediate voltage Vzw, the voltage Vepi, the bias voltage Vvs, may be used to provide improved voltage-stability for other circuit arrangements than when coupled to the supply voltages Vpos, Vneg.

Figure 5:
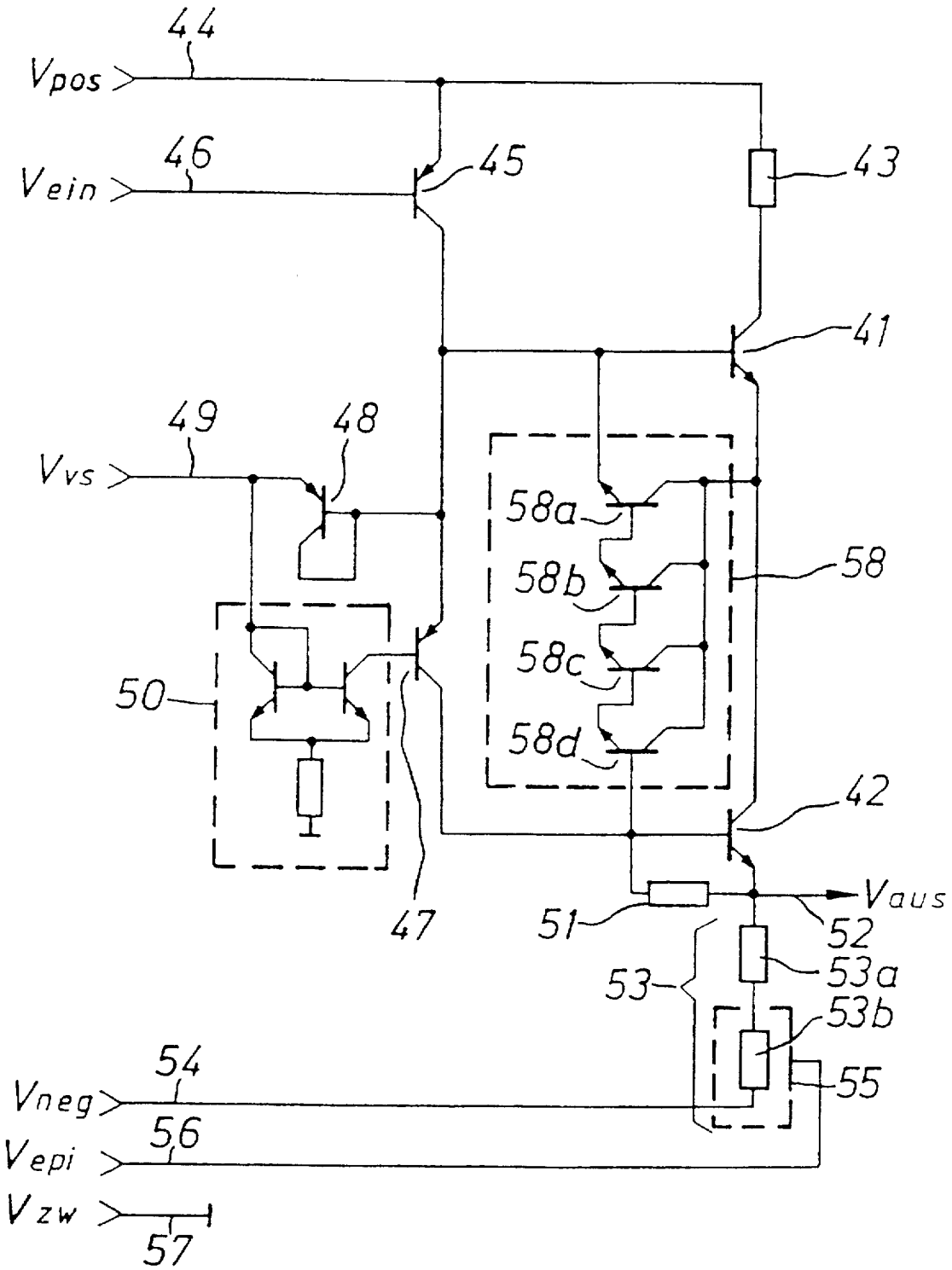
FIG. 5 shows a preferred application example for the arrangement according to FIG. 4.

FIG. 5 illustrates a possible downstream circuit arrangement which utilizes the full supply voltage range Vpos and Vneg at the connection terminals. The circuit arrangement of FIG. 5 may be realized in an integrated form employing a manufacturing process designed for blocking voltages which lie below the voltage difference Vpos–Vneg.

A cascode stage is illustrated in FIG. 5 comprising a first cascode transistor 41 and a second cascode transistor 42. The collector of the first cascode transistor 41 is connected to a first end of a collector impedance 43, the second end of which is connected to supply voltage Vpos at connection 44. Supply voltage Vpos is also connected to the emitter of a first driver transistor 45, the base of which leads to a cascode input terminal 46, Vein. The collector of the first driver transistor 45 is connected to the junction of the emitter of a second driver transistor 47 and the base of the first cascode transistor 41. The base and collector of transistor 48 are tied together and connected to the collector of transistor 45. The emitter of transistor 48 is connected to a second supply connection 49, VVS, and to an input of a current reflector 50. The output of current reflector 50 is coupled to the base of the second driver transistor 47. The collector of transistor 47 is connected to the base of the second cascode transistor 42 and to a first end of a resistor 51, the second end being connected to the emitter of transistor 42. The emitter of transistor 42 is connected to an output terminal 52, delivering output voltage Vaus. Voltage Vaus is dependent on the input voltage Vein. Terminal 52 is also coupled to a first end of an emitter impedance 53 formed by resistors **53*a* and 53*b* wired in series. The second end of emitter impedance 53 is connected to a third voltage supply connection 54**, to which Vneg is applied.

The resistors **53*a*, 53*b* are structured, as is normal in an integrated circuit, in such a way that regions of a base diffusion embedded in an epitaxial trough, also called "box", determine the electrical values of the respective resistance. The epitaxial trough 55 of the resistor 53*b* is electrically connected to a fourth supply connection 56, to which the voltage Vepi is applied. The intermediate voltage Vzw is applied, via the fifth supply connection 57, to the ground of the circuit arrangement according to FIG. 5**, where the ground is identical with the substrate/insulation terminal as is normal in an integrated circuit. The intermediate voltage Vvz preferably has a value which is essentially half of the voltages Vpos and Vneg, i.e.

$$Vvz=\tfrac{1}{2}(Vpos-Vneg).$$

The following viewpoints are particularly essential with the circuit arrangement according to FIG. 5. Since the output voltage Vaus may have values which essentially correspond to Vpos, a voltage difference approaching Vpos–Vneg may exist at the emitter impedance 53. Since the precondition requires, this voltage difference may be above the permissible blocking voltage values predetermined by the manufacturing process, for example, VCBO. However, in order that the emitter impedance 53 in the case of the manufacturing process used is nevertheless capable of sustaining this voltage difference, impedance 53 is divided into the two resistors **53*a* and 53*b* which in this embodiment example possess equal resistance values. Thus, a voltage drop at each of the two resistors corresponds to half of the voltage difference value (Vpos–Vneg). In order to guarantee that the epitaxial trough 55 of the resistor 53*b*** lies at a voltage value which has a permissible separation to both the voltage Vpos and the voltage Vneg, it is coupled to a potential corresponding to the voltage Vepi. The voltage Vepi here is selected such that the difference from voltages Vpos and Vneg is not too large and, the value does not lie below the intermediate voltage Vzw which is applied to the substrate.

Furthermore, it is fundamental that the voltage applied to the collector terminal and hence to the epitaxial trough of the second cascode transistor 42 has a value greater than or equal to the substrate voltage Vzw. This is achieved by the bias voltage Vvs which is applied to the second supply connection 49 and which is fed via the base-emitter diodes of transistors 48, 41 to the collector terminal of transistor 42 where it exhibits a value larger than that of the substrate voltage. Thus parasitic effects, such as parasitic triac conduction between the substrate, the epitaxial region of transistor 42, the base of transistor 42 and the emitter of transistor 42, can be avoided.

The circuit arrangement of FIG. 5 may contain a fourth Zener block 58 as shown in FIG. 5 by the dotted line. This has a similar structure to the Zener blocks already described and consists of four Zener transistors **58*a*–58*d*. A voltage difference between the collector and the base regions of transistor 42 is limited by Zener block 58** to a value of 4 * Vzt, where Vzt corresponds to the breakdown voltage of the transistors **58*a*–58*d***. However, at this point it should be pointed out again that the use of the invention-type device for generating an intermediate voltage is not restricted to raising the voltage-stability of an integrated circuit; rather, this is merely a preferred application. On the other hand, the intermediate voltages which lead to increased voltage-stability of a component like, for example, an integrated circuit, can also be provided by other suitable devices.

The inventive device according to FIG. 1 delivers an intermediate voltage value between the applied supply voltages Vpos, Vneg. The intermediate voltage is generated by a current flowing through an arrangement of components which realize the characteristic function of a Zener diode (Zener diode 26, Zener block 26'). Zener diode 26, or Zener block 26' is controlled by an adjustable current from current source 28. Current source 28 is controlled responsive to a comparator output signal value which results from comparing the nominal or reference voltage (nominal value) with the voltage dropped across resistor 22, which is wired in series with the Zener diode or Zener block and the current source.

Further versions of the inventive device may comprise further components and blocks generating additional voltages values between those of the supply voltages Vpos, Vneg.

The inventive device is characterized by good dynamic stability with low power dissipation. In a preferred application the inventive circuit arrangement may be realized with integrated technology where the intermediate voltages are applied to individual diffusion regions, to increase the voltage-stability of the integrated circuit. The voltage-stability of other downstream circuitry not forming part of the intermediate voltage device may be increased, for example, by cascading resistors or wiring them in series.

With both the individual stages of the device for generating intermediate voltages and also the downstream stages (components) it should be observed that all circuit sections, the corresponding epitaxial regions (collector with NPN transistors, base with PNP transistors, and "box" for resistor), which are operated, as far as the potential is concerned, below the intermediate voltage Vzw, lie, as far as the potential is concerned, above or in any case at the intermediate voltage Vzw.

We claim:

1. Apparatus for generating an intermediate voltage having a value between a positive voltage supply value and a negative supply value, said apparatus comprising:

a voltage comparator having first and second inputs and generating an output signal;

a reference voltage generator coupled to said positive voltage supply and generating a reference voltage for coupling to said first input;

a device having a zener characteristic coupled to said positive voltage supply and generating a voltage for coupling to said second input; and, a current source coupled to said negative voltage supply generating a current for coupling to a terminal to form said intermediate voltage and coupled to said device for determining said voltage generated by said device, said output signal controlling said current source.

2. The apparatus of claim 1, wherein said device comprises a plurality of transistors connected to form diodes coupled in series.

3. The apparatus of claim 1, wherein said apparatus is constructed as part of an integrated circuit.

4. The apparatus of claim 3, wherein said comparator is a cascode amplifier having epitaxial regions at a potential of at least that of said intermediate voltage.

5. The apparatus of claim 2, further comprising a second device having a zener characteristic coupled to said negative voltage supply and generating a second current for coupling to a second terminal to form a second intermediate voltage and coupled to a current mirror coupled to said reference voltage generator.

6. The apparatus of claim 5, wherein defusion regions of said integrated circuit are coupled to said second intermediate voltage.

7. The apparatus of claim 5, wherein substrate regions of said integrated circuit are coupled to said second intermediate voltage.

8. An integrated circuit requiring an intermediate voltage source having a value between a positive voltage supply coupled to a first connection terminal and a negative supply coupled to a second connection terminal, said integrated circuit comprising:

a cascode voltage comparator having first and second inputs and generating an output signal;

a reference voltage generator coupled to said first connection terminal and generating a reference voltage for coupling to said first input;

a plurality of transistors connected as diodes and coupled in series having a zener characteristic, said plurality being coupled to said first connection terminal and generating a voltage for coupling to said second input; and, a controllable current source coupled to said second connection terminal generating a current for coupling to form said intermediate voltage source and coupled to said plurality for determining said voltage generated by said plurality, said output signal controlling said current source.

9. The integrated circuit of claim 8, wherein a capacitor couples said output signal to said second input.

10. The integrated circuit of claim 8, wherein a capacitor couples a base electrode to a collector electrode of an output transistor of said cascode voltage comparator.

* * * * *